US009974992B2

(12) United States Patent
Zhang et al.

(10) Patent No.: US 9,974,992 B2
(45) Date of Patent: May 22, 2018

(54) FIRE EXTINGUISHING COMPOSITION COMPRISING CARBOXYLIC ACID DERIVATIVE

(71) Applicant: Xi'an Westpeace Fire Technology Co., Ltd, Xi'an Shaanxi (CN)

(72) Inventors: Sanxue Zhang, Xi'an Shaanxi (CN); Xiaoyu Han, Xi'an Shaanxi (CN); Junjun Shi, Xi'an Shaanxi (CN); Yi Liu, Xi'an Shaanxi (CN); Zhengjun Lei, Xi'an Shaanxi (CN)

(73) Assignee: Xi'an Westpeace Fire Technology Co., Ltd., Xi'an Shaanxi (CN)

( * ) Notice: Subject to any disclaimer, the term of this patent is extended or adjusted under 35 U.S.C. 154(b) by 0 days. days.

(21) Appl. No.: 15/111,146

(22) PCT Filed: Mar. 11, 2015

(86) PCT No.: PCT/CN2015/074033
§ 371 (c)(1),
(2) Date: Jul. 12, 2016

(87) PCT Pub. No.: WO2015/104004
PCT Pub. Date: Jul. 16, 2015

(65) Prior Publication Data

US 2016/0332015 A1 Nov. 17, 2016

(30) Foreign Application Priority Data

Jan. 13, 2014 (CN) ..... 2014 1 0014547

(51) Int. Cl.
*A62D 1/06* (2006.01)

(52) U.S. Cl.
CPC ..... *A62D 1/06* (2013.01)

(58) Field of Classification Search
CPC ..... A62D 1/06
See application file for complete search history.

(56) References Cited

U.S. PATENT DOCUMENTS

| | | | | |
|---|---|---|---|---|
| 4,665,993 | A | 5/1987 | Balassa | |
| 5,520,826 | A | 5/1996 | Reed, Jr. et al. | |
| 8,257,607 | B1 | 9/2012 | Johnson et al. | |
| 8,778,213 | B2 * | 7/2014 | Guo | A62D 1/06 169/44 |
| 8,871,110 | B2 * | 10/2014 | Guo | A62D 1/06 169/44 |
| 9,662,522 | B2 | 5/2017 | Liu et al. | |
| 2002/0137875 | A1 | 9/2002 | Reed et al. | |
| 2009/0069496 | A1 | 3/2009 | Sortwell | |
| 2013/0221264 | A1 * | 8/2013 | Guo | A62D 1/06 252/6 |
| 2014/0183399 | A1 | 7/2014 | Yao et al. | |
| 2014/0374641 | A1 | 12/2014 | Liu et al. | |
| 2016/0332014 | A1 | 11/2016 | Shi et al. | |
| 2016/0332016 | A1 | 11/2016 | Yao et al. | |
| 2017/0043196 | A1 | 2/2017 | Wu et al. | |

FOREIGN PATENT DOCUMENTS

| | | | | |
|---|---|---|---|---|
| CN | 102179027 | A * | 9/2011 | A62D 1/06 |
| CN | 102824715 | A | 12/2012 | |
| CN | 102861409 | A | 1/2013 | |
| CN | 102949802 | A | 3/2013 | |
| CN | 102949803 | A | 3/2013 | |
| CN | 102993626 | A | 3/2013 | |
| CN | 103170082 | A | 6/2013 | |
| CN | 103736236 | A | 4/2014 | |
| CN | 103736237 | A | 4/2014 | |
| CN | 103736239 | A | 4/2014 | |
| CN | 103785130 | A | 5/2014 | |
| KR | 20060092192 | A | 8/2006 | |
| WO | WO 2009/032587 | A1 | 3/2009 | |
| WO | WO 2012/034492 | A1 | 3/2012 | |
| WO | WO 2015/104004 | A1 | 7/2015 | |
| WO | WO 2015/104005 | A1 | 7/2015 | |
| WO | WO 2015/104006 | A1 | 7/2015 | |
| WO | WO 2015/104007 | A2 | 7/2015 | |

OTHER PUBLICATIONS

PCT/CN2015/074033 English Translation of the International Preliminary Report on Patentability dated Jul. 19, 2016 entitled "Fire Extinguishing Composition Comprising Carboxylic Acid Derivative."
PCT/CN2015/074033 English Translation of the International Search Report dated May 29, 2015 entitled "Fire Extinguishing Composition Comprising Carboxylic Acid Derivative."
PCT/CN2015/074033 English Translation of the Written Opinion dated May 29, 2015 entitled "Fire Extinguishing Composition Comprising Carboxylic Acid Derivative."
PCT/CN2015/074043 English Translation of the International Preliminary Report on Patentability dated Jul. 19, 2016 entitled "Fire Extinguishing Composition Comprising Heterocyclic Compounds."
PCT/CN2015/074043 English Translation of the International Search Report dated May 27, 2015 entitled "Fire Extinguishing Composition Comprising Heterocyclic Compounds."
(Continued)

*Primary Examiner* — Peter F Godenschwager
(74) *Attorney, Agent, or Firm* — Hamilton, Brook, Smith & Reynolds, P.C.

(57) ABSTRACT

The present invention relates to a fire-extinguishing composition containing a carboxylic acid derivative. The fire-extinguishing composition releases a great quantity of active fire-extinguishing particles by making use of the heat generated from combustion of a pyrotechnic agent. The fire-extinguishing composition containing a carboxylic acid derivative in the present invention is decomposed at a high temperature to generate free radicals and takes reaction with one or more of O—, OH—, H— free radicals necessary for a chain combustion reaction through the free radicals, so as to cut off the chain combustion reaction and take physical and chemical inhibiting effects to jointly achieve a fire extinguishing effect at the same time. Meanwhile, it takes synergistic interaction effects with the pyrotechnic agent to further raise the fire extinguishing efficiency of the fire extinguishing agent and greatly shorten the effective fire extinguishing time.

7 Claims, No Drawings

(56) References Cited

OTHER PUBLICATIONS

PCT/CN2015/074043 English Translation of the Written Opinion dated May 27, 2015 entitled "Fire Extinguishing Composition Comprising Heterocyclic Compounds."
PCT/CN2015/074044 English Translation of the International Preliminary Report on Patentability dated Jul. 19, 2016 entitled "Fire Extinguishing Composition Comprising Aldoketones Compound."
PCT/CN2015/074044 English Translation of the International Search Report dated May 29, 2015 entitled "Fire Extinguishing Composition Comprising Aldoketones Compound."
PCT/CN2015/074044 English Translation of the Written Opinion dated May 29, 2015 entitled "Fire Extinguishing Composition Comprising Aldoketones Compound."
PCT/CN2015/074045 English Translation of the International Preliminary Report on Patentability dated Jul. 19, 2016 entitled "Fire Extinguishing Composition Comprising Alcohol Phenol Compound and Derivative Thereof."
PCT/CN2015/074045 English Translation of the International Search Report dated Jun. 17, 2015 entitled "Fire Extinguishing Composition Comprising Alcohol Phenol Compound and Derivative Thereof."
PCT/CN2015/074045 English Translation of the Written Opinion dated Jun. 17, 2015 entitled "Fire Extinguishing Composition Comprising Alcohol Phenol Compound and Derivative Thereof."
Chemspider, The free chemical database, "Benzophenone", Oct. 23, 2012.

* cited by examiner

FIRE EXTINGUISHING COMPOSITION COMPRISING CARBOXYLIC ACID DERIVATIVE

RELATED APPLICATIONS

This application is the U.S. National Stage of International Application No. PCT/CN2015/074033, filed Mar. 11, 2015, which designates the U.S., published in Chinese, and claims priority under 35 U.S.C. § § 119 or 365(c) to China (PRC) Application No. CN 201410014547.7, filed Jan. 13, 2014. The entire teachings of the above applications are incorporated herein by reference.

FIELD OF THE INVENTION

The present invention pertains to the technical field of aerosol fire distinguishing, and particularly to a thermal aerosol fire-extinguishing composition.

BACKGROUND OF THE INVENTION

Since the specific target of each country for substitution of Halon fire extinguishing agents was put forth in Canadian Montreal Convention in 1987, all countries in the world have been committed to the research of new fire extinguishing techniques. Fire extinguishing techniques with high fire extinguishing efficiency and no environmental pollution are aims of our effort.

A gas fire extinguishing system, a powder extinguishing system, a water fire extinguishing system and the like are harmless to environment, so they are selected as substitutes of Halon fire extinguishing agents and are widely used. The fire extinguishing mechanism of the fire extinguishing systems of carbon dioxide, IG541 and inert gases mainly relies on physical fire extinguishing. The fire is put out by lowering the concentration of oxygen in the firing area. This fire extinguishing method would easily threaten human safety. The powder extinguishing system puts out a fire by spraying powder under the action of pressurized gas to contact flame and realize physical and chemical suppression effect. The water mist fire extinguishing system achieves the objects of controlling, suppressing and putting out a fire through triple actions of cooling, smothering, and isolation of thermal radiation by using water mist.

However, all these fire extinguishing systems need high pressure storage. Not only the volume is large but also there is a risk of physical explosion during storage. A document "Safety Analysis of Gas Fire Extinguishing System" (Fire Science and Technology 2002 21(5)) analyzes the risk of a gas fire extinguishing system and enumerates the safety accidents triggered by the stored pressure gas fire extinguishing system during use.

The existing thermal aerosol fire extinguishing agents are mainly type S and type K fire extinguishing agents. The comprehensive analysis of their performance and features indicates that their fire extinguishing mechanism is that the thermal aerosol fire extinguishing agents take a redox reaction through agent combustion to release a great quantity of gas and active particles and the goal of integrated chemical and physical fire extinguishing is realized through the chain scission reaction of the active particles and covering and smothering of a great quantity of gas. The disadvantage of the thermal aerosol fire extinguishing agents is that the thermal aerosol fire extinguishing agent will release a great quantity of heat while it takes the combustion reaction to release the thermal aerosol, which may cause a secondary combustion. In order to effectively reduce the temperature of the device and aerosol and avoid the secondary fire, a cooling system needs to be added. The cooling materials of the existing thermal aerosol fire extinguishing devices can reduce the temperature of products, but they also greatly weaken the fire extinguishing performance of the products. In order to make up the loss on the fire extinguishing performance caused by the cooling system, many products either lower the fire extinguishing level or continuously increase the mass of the actual fire extinguishing agent, rendering the increase of product volume and the decrease of use efficiency, which results in a complex and cumbersome structure of the device, a complex technological process, a high cost, and a high nozzle temperature, which would easily cause injury to fire fighters.

SUMMARY OF THE INVENTION

Regarding the current situation of existing fire extinguishing devices, particularly the inherent defects of an aerosol fire extinguishing system, an object of the present invention is to provide a safer and more efficient fire-extinguishing composition.

The technical scheme of the present invention is:

A fire-extinguishing composition containing a carboxylic acid derivative, wherein the fire-extinguishing composition contains a carboxylic acid derivative; the fire-extinguishing composition releases a great quantity of active fire-extinguishing particles by making use of combustion of a pyrotechnic agent.

Further, the mass percentage of the carboxylic acid derivative in the fire-extinguishing composition is 35% or above.

Further, the carboxylic acid derivative comprises one or more of anhydride, ester, amide and acyl halide compounds.

Further, the anhydride compound comprises: trimellitic anhydride, tetrachlorophthalic anhydride, phthalic anhydride, succinic anhydride, 3,6 endomethenyl-1,2,3,6 tetrahydrophthalic anhydride, maleic anhydride, isatoic anhydride, 5-bromoisatoic anhydride, tetrachlorophthalic anhydride, tetrabromophthalic anhydride, 1,8-naphthalic anhydride, creatinine, butanedioic anhydride (succinic anhydride), 1,8-naphthalic anhydride, benzoic anhydride and 2,3-dichloromaleic anhydride.

Further, the ester compound comprises: dimethyl oxalate, dimethyl terephthalate, polyvinyl acetate, triphenyl phosphate, butyl p-hydroxybenzoate, dicyclohexyl phthalate, benzyl hydrazinocarboxylate, methyl hydrazinocarboxylate, propylgallate, methyl gallate, L-ascorbyl palmitate, 1,1'-binaphthyl-2,2'-diyl hydrogen phosphate, 3-amino-4-methyl-toluate, 2-chlorobenzyl-N-succinimidyl carbonate, 4-methyl chlorocarbonylbenzoate, propyl p-hydroxybenzoate, methyl p-hydroxybenzoate and ethyl p-hydroxybenzoate.

Further, the amide compound comprises: phthalimide, para toluene sulfonamide, acetamide, salicylamide, acetanilide, N-hydroxymethyl acrylamide, acrylamide, propanamide, pentanamide, nicotinamide, benzamide, cinnamamide, isobutyramide, 4-acetamidobenzenesulfonyl chloride, amino-sulfamide, cyanoacetamide, trifluoroacetamide, 2-phenylacetamide, 2-chloroacetamide, L-glutamine, methacrylamide, ferrocenecarboxamide, thiobenzamide, 4-pyridine carboxamide, N-phenyl carboxamide, N-methyl carboxamide, anthranilamide, diacetone acrylamide, 4-aminobenzamide, 4-carboxybenzene sulfonamide, N-methylbenzamide, N-acetylcaprolactam, 2,6-dichlorobenzamide, N-methyl-para toluene sulfonamide, N,N-diethyl-chloro-acetamide and salicylanilide.

Further, the acyl halide compound comprises: paraphthaloyl chloride, hexanoyl chloride, furoyl chloride, valeryl chloride, decanedioyl chloride, isobutyryl chloride, benzenemethanesulfonyl chloride, monomethyl oxalyl chloride, ethylsulfonyl chloride, p-fluorobenzoyl chloride, isophthaloyl chloride, o-phthaloyl chloride, methacryloyl chloride, diphenylcarbamyl chloride, m-methyl benzoyl chloride, 4-acetamidobenzenesulfonyl chloride, 2-bromoisobutyryl bromide, isophthaloyl bromide, 4-fluorobenzoylbromide, o-phenyldiformyl bromide, sebacoyl bromide and phenylmethylsulfonyl bromide.

Further, the fire-extinguishing composition comprises an auxiliary fire-extinguishing material.

Further, the auxiliary fire-extinguishing materials comprise: brominated flame retardants, chlorinated flame retardants, organophosphorus flame retardants, phosphorus-halogen flame retardants, nitrogen flame retardants, phosphorus-nitrogen flame retardants, inorganic flame retardants or any of their combinations.

Further, the fire-extinguishing composition comprises an additive and the content of the additive is 0.1-10%.

Further, the additive is a mold release agent, an adhesive, a catalyst or an additive with other performances, such as: one or more of stearate, graphite, sodium silicate, phenolic resin, shellac, starch, dextrin, rubber, epoxy resin, acetal adhesive and hydroxypropyl methyl cellulose. In addition to the substances listed above, all other organic or inorganic substances that can realize the foregoing functions may be used as substitutes of the additives in the fire-extinguishing composition of the present invention.

Further, the components of the fire-extinguishing composition and their mass percentages are:

| | |
|---|---|
| the carboxylic acid derivative | 35%-90% |
| the auxiliary fire-extinguishing material | 5%-60% |
| the additive | 2%-10% |

Further, the components of the fire-extinguishing composition and their mass percentages are:

| | |
|---|---|
| the carboxylic acid derivative | 55%-90% |
| the auxiliary fire-extinguishing material | 5%-40% |
| the additive | 4%-8% |

The fire-extinguishing composition of the present invention adopts the following flame suppression mechanism:

During use, the pyrotechnic agent is used as a source of heat and a source of power. The heat released from ignition and combustion of the pyrotechnic agent makes the carboxylic acid derivative react at a high temperature to generate free radical alkyl (or aryl), free radical acyl, free radical carbonyl, and other active fire-extinguishing particles. These active fire-extinguishing particles react with one or more of O—, OH—, H— free radicals necessary for the chain combustion reaction, thereby cutting off the chain combustion reaction. Meanwhile, they take a synergistic interaction effect with the pyrotechnic agent to further raise the fire extinguishing efficiency of the fire extinguishing agent and greatly shorten the effective fire extinguishing time.

As compared with the existing thermal aerosol fire extinguishing agents, the fire-extinguishing composition of the present invention has the following advantages:

1. The carboxylic acid derivative in the fire-extinguishing composition of the present invention reacts at a high temperature to generate a great quantity of nanoscale active fire-extinguishing particles and various kinds of free radicals, to cut off the combustion reaction chain, work together with the reaction products of thermal aerosol generating agent to jointly play a fire extinguishing effect, further raise the fire extinguishing efficiency of the fire extinguishing agent and shorten the effective fire extinguishing time.
2. The fire-extinguishing composition of the present invention makes use of the heat generated from the combustion of the aerosol generating agent to take the endothermic reaction fast, thereby absorbing the heat released from the combustion of the pyrotechnic agent and reducing the temperature at a nozzle of the fire extinguishing device. Therefore, the fire-extinguishing composition is safer, would not do harm to fire fighters and also avoids secondary fires.
3. An aerosol fire extinguishing device adopting the fire-extinguishing composition of the present invention does not need a cooling system with a complex structure and a large volume, so it has the characteristics of a handy structure, a simple technological process and good economy.

DETAILED DESCRIPTION OF THE EMBODIMENTS

Below are embodiments of the present invention for illustrating a technical scheme for solving the technical problems in this application document and helping those skilled in the art understand the content of the present invention, however, the realization of the technical scheme of the present invention is not limited to these embodiments.

Take the fire-extinguishing composition and additive of the present invention in proportion, use water as a solvent, pelletize by using a 20-mesh sieve, then add a mold release agent, and after mixing the same, the mixture is sieved by a 15-mesh sieve and molded into a shape of ball, slice, strip, block or honeycomb through adopting pelleting, mould pressing, extruding or other processes; add 50 g of the mixture to a fire extinguishing device filled with 50 g of a type K aerosol generating agent, and a fire extinguishing experiment is performed according to a fire extinguishing experiment model.

Comparative Example 1

Use a fire extinguishing device sample containing 50 g of a K salt type aerosol fire extinguishing agent and perform a fire extinguishing experiment according to the fire extinguishing experiment model.

Comparative Example 2

Use a fire extinguishing device sample containing 50 g of a type S aerosol fire extinguishing agent and perform a fire extinguishing experiment according to the fire extinguishing experiment model.

The fire extinguishing experiment model is an oil tray fire extinguishing experiment:

The formulae of the fire-extinguishing composition of the present invention undergo 93# gasoline 8B fire extinguishing experiments with an implementing area of 0.25 $m^2$ by the experiment method described in 6.3.2.1 of GA86-2009 Simplified Fire Extinguisher standard. Experiment is performed for three times for each formula. Fire extinguishing effects, fire extinguishing time and nozzle temperatures are recorded. The experimental results are shown in the tables below:

TABLE 1

Comparison of various components and ingredients and comparison of fire extinguishing test results thereof

| Component | Embodiment component content (mass percentage) 1 | 2 | 3 | 4 | 5 | 6 | 7 | 8 | 9 | Comparative example 1 | Comparative example 2 |
|---|---|---|---|---|---|---|---|---|---|---|---|
| Commercial type K aerosol | | | | | | | | | | ● | |
| Commercial type S aerosol | | | | | | | | | | | ● |
| Trimellitic anhydride | 100 | | | | | | | | | | |
| Tetrachlorophthalic anhydride | | 95 | | | | | | | | | |
| 1,8-naphthalic anhydride | | | 90 | | | | | | | | |
| Dimethyl oxalate | | | | 90 | | | | | | | |
| Dimethyl terephthalate | | | | | 90 | | | | | | |
| Propyl p-hydroxybenzoate | | | | | | 90 | | | | | |
| Phthalimide | | | | | | | 90 | | | | |
| Propanamide | | | | | | | | 90 | | | |
| Salicylamide | | | | | | | | | 90 | | |
| Acetal adhesive | | | 2 | | | 2 | | | 2 | | |
| Sodium silicate | | 1 | | | 3 | | | 3 | | | |
| Magnesium stearate | | 2 | 5 | 5 | 5 | 5 | 5 | 5 | 5 | | |
| Hydroxypropyl methyl cellulose | | 2 | 3 | 5 | 2 | 3 | 5 | 2 | 3 | | |
| Nozzle temperature ° C. | 863 | 785 | 697 | 786 | 805 | 603 | 752 | 695 | 762 | 1254 | 1362 |
| Fire extinguishing performance | Full Extinc-tions | 2 Extinc-tions out of 3 | 2 Extinc-tions out of 3 | Full Extinc-tions | 2 Extinc-tions out of 3 | Full Extinc-tions | Full Extinc-tions | Full Extinc-tions | Full Extinc-tions | No Extinctions | No Extinctions |
| Fire extinguishing time s | 6 | 7 | 6 | 5 | 8 | 5 | 6 | 6 | 8 | | |

TABLE 2

Comparison of various components and ingredients and comparison of fire extinguishing test results thereof

| Component | Embodiment component content (mass percentage) 10 | 11 | 12 | Comparative example 1 | Comparative example 2 |
|---|---|---|---|---|---|
| Commercial type K aerosol | | | | ● | |
| Commercial type S aerosol | | | | | ● |
| Paraphthaloyl chloride | 90 | | | | |
| Monomethyl oxalyl chloride | | 90 | | | |
| o-phthaloyl chloride | | | 90 | | |
| Acetal adhesive | | | 2 | | |
| Sodium silicate | | 3 | | | |
| Magnesium stearate | 5 | 5 | 5 | | |

TABLE 2-continued

Comparison of various components and ingredients and comparison of fire extinguishing test results thereof

| Component | Embodiment component content (mass percentage) 10 | 11 | 12 | Comparative example 1 | Comparative example 2 |
|---|---|---|---|---|---|
| Hydroxypropyl methyl cellulose | 5 | 2 | 3 | | |
| Nozzle temperature ° C. | 852 | 687 | 697 | 1254 | 1362 |
| Fire extinguishing performance | Full Ex-tinc-tions | 2 Ex-tinc-tions out of 3 | 2 Ex-tinc-tions out of 3 | No Ex-tinc-tions | No Ex-tinc-tions |
| Fire extinguishing time s | 5 | 8 | 8 | | |

TABLE 3

Comparison of various components and ingredients and comparison of fire extinguishing test results thereof

| Component | Embodiment component content (mass percentage) 13 | 14 | 15 | 16 | 17 | 18 | 19 | Comparative example 1 | Comparative example 2 |
|---|---|---|---|---|---|---|---|---|---|
| Commercial type K aerosol | | | | | | | | ● | |
| Commercial type S aerosol | | | | | | | | | ● |
| Trimellitic anhydride | 35 | 58 | | | | | | | |
| Tetrachlorophthalic anhydride | | | 65 | 70 | | | | | |
| 1,8-naphthalic anhydride | | | | | 79 | 86 | | | |
| Dimethyl oxalate | | | | | | | 90 | | |
| Ammonium polyphosphate | 45 | | | | | | 5 | | |
| Melamine | | 22 | | 13 | | | | | |
| Monopotassium phosphate | | 16 | | | | 10 | | | |
| Sodium bicarbonate | 15 | | | | 10 | | | | |
| Aluminum hydroxide | | | 11 | | 7 | | | | |
| Dicyandiamide | | | 20 | 13 | | | | | |
| Magnesium stearate | 2 | 2 | 2 | 2 | 2 | 2 | 2 | | |
| Hydroxypropyl methyl cellulose | 3 | 2 | 2 | 2 | 2 | 2 | 3 | | |
| Nozzle temperature ° C. | 702 | 688 | 742 | 746 | 812 | 801 | 699 | 1258 | 1371 |
| Fire extinguishing performance | Full Extinctions | Full Extinctions | Full Extinctions | Full Extinctions | 2 Extinctions out of 3 | Full Extinctions | Full Extinctions | No Extinctions | No Extinctions |
| Fire extinguishing time s | 4 | 5 | 4 | 4 | 6 | 5 | 4 | | |

TABLE 4

Comparison of various components and ingredients and comparison of fire extinguishing test results thereof

| Component | Embodiment component content (mass percentage) 20 | 21 | 22 | 23 | 24 | 25 | 26 | Comparative example 1 | Comparative example 2 |
|---|---|---|---|---|---|---|---|---|---|
| Commercial type K aerosol | | | | | | | | ● | |
| Commercial type S aerosol | | | | | | | | | ● |
| Dimethyl oxalate | 52 | | | | | | | | |
| Dimethyl terephthalate | | 60 | | | | | | | |
| Propyl p-hydroxybenzoate | | | 66 | | | | | | |
| Phthalimide | | | | 72 | 80 | | | | |
| Propanamide | | | | | | 84 | 90 | | |
| Ammonium polyphosphate | 40 | | | | | 4 | | | |
| Melamine | | 18 | | 14 | | | 6 | | |
| Monopotassium phosphate | | 18 | | | | 8 | | | |
| Sodium bicarbonate | | | | | 9 | | | | |
| Aluminum hydroxide | | | 14 | | 7 | | | | |
| Dicyandiamide | | | 16 | 10 | | | | | |
| Magnesium stearate | 5 | 2 | 2 | 2 | 2 | 2 | 2 | | |
| Hydroxypropyl methyl cellulose | 3 | 2 | 2 | 2 | 2 | 2 | 2 | | |

TABLE 4-continued

| Comparison of various components and ingredients and comparison of fire extinguishing test results thereof | | | | | | | | | |
|---|---|---|---|---|---|---|---|---|---|
| | Embodiment component content (mass percentage) | | | | | | | Comparative | Comparative |
| Component | 20 | 21 | 22 | 23 | 24 | 25 | 26 | example 1 | example 2 |
| Nozzle temperature ° C. | 751 | 681 | 746 | 748 | 798 | 804 | 873 | 1258 | 1371 |
| Fire extinguishing performance | Full Extinctions | Full Extinctions | 2 Extinctions out of 3 | Full Extinctions | 2 Extinctions out of 3 | Full Extinctions | Full Extinctions | No Extinctions | No Extinctions |
| Fire extinguishing time s | 4 | 5 | 5 | 4 | 5 | 5 | 4 | | |

TABLE 5

| Comparison of various components and ingredients and comparison of fire extinguishing test results thereof | | | | | | | | | |
|---|---|---|---|---|---|---|---|---|---|
| | Embodiment component content (mass percentage) | | | | | | | Comparative | Comparative |
| Component | 27 | 28 | 29 | 30 | 31 | 32 | 33 | example 1 | example 2 |
| Commercial type K aerosol | | | | | | | | ● | |
| Commercial type S aerosol | | | | | | | | | ● |
| Salicylamide | 50 | 55 | | | | | | | |
| Paraphthaloyl chloride | | | 66 | 70 | | | | | |
| Monomethyl oxalyl chloride | | | | | 75 | 80 | | | |
| o-phthaloyl chloride | | | | | | | 90 | | |
| Ammonium polyphosphate | | 20 | | | | 8 | | | |
| Melamine | 30 | | | 14 | | | | | |
| Monopotassium phosphate | | 21 | | | | | 6 | | |
| Sodium bicarbonate | | | 14 | | 14 | | | | |
| Aluminum hydroxide | | | | 8 | 7 | | | | |
| Dicyandiamide | 15 | | 16 | | | 8 | | | |
| Magnesium stearate | 2 | 2 | 2 | 3 | 2 | 2 | 2 | | |
| Hydroxypropyl methyl cellulose | 3 | 2 | 2 | 5 | 2 | 2 | 2 | | |
| Nozzle temperature ° C. | 847 | 789 | 807 | 798 | 826 | 877 | 758 | 1258 | 1371 |
| Fire extinguishing performance | Full Extinctions | 2 Extinctions out of 3 | Full Extinctions | Full Extinctions | 2 Extinctions out of 3 | 2 Extinctions out of 3 | Full Extinctions | No Extinctions | No Extinctions |
| Fire extinguishing time s | 4 | 5 | 3 | 4 | 6 | 5 | 4 | | |

The foregoing embodiments are merely explanations to the preferred schemes of the present invention, and are not the limitation to the present invention. All changes and modifications to the foregoing embodiments within the essential spirit scope of the present invention should fall within the scope of protection of the claims of the present application.

What is claimed is:

1. A fire-extinguishing composition comprising:

35%-90% by mass of one or more of: an anhydride compound, an ester compound, an amide compound, and an acyl halide compound;

5%-60% by mass of an auxiliary fire-extinguishing material; and

2%-10% by mass of an additive, wherein:

i) the anhydride compound is one or more of trimellitic anhydride, phthalic anhydride, succinic anhydride, 3,6 endomethenyl-1,2,3,6 tetrahydrophthalic anhydride, maleic anhydride, isatoic anhydride, 5-bromoisatoic anhydride, 1,8-naphthalic anhydride, creatinine, butanedioic anhydride (succinic anhydride), 1,8-naphthalic anhydride, benzoic anhydride and 2,3-dichloromaleic anhydride;

ii) the ester compound is one or more of dimethyl oxalate, dimethyl terephthalate, polyvinyl acetate, triphenyl phosphate, butyl p-hydroxybenzoate, dicyclohexyl phthalate, benzyl hydrazinocarboxylate, methyl hydrazinocarboxylate, propylgallate, methyl gallate, L-ascorbyl palmitate, 1,1'-binaphthyl-2,2'-diyl hydrogen phosphate, 3-amino-4-methyl-toluate, 2-chlorobenzyl-N-succinimidyl carbonate, 4-methyl chlorocarbonylbenzoate, propyl p-hydroxybenzoate, methyl p-hydroxybenzoate and ethyl p-hydroxybenzoate;

iii) the amide compound is one or more of phthalimide, para toluene sulfonamide, acetamide, salicylamide, acetanilide, N-hydroxymethyl acrylamide, acrylamide, propanamide, pentanamide, nicotinamide, benzamide, cinnamamide, isobutyramide, 4-acetamidobenzenesulfonyl chloride, amino-sulfamide, cyanoacetamide, trifluoroacetamide, 2-phenylacetamide, 2-chloroacetamide, L-glutamine, methacrylamide, thiobenzamide, 4-pyridine carboxamide, N-phenyl carboxamide, N-methyl carboxamide, anthranilamide, diacetone acrylamide, 4-aminobenzamide, 4-carboxybenzene sulfonamide, N-methylbenzamide, N-acetylcaprolactam, 2,6-dichlorobenzamide, N-methyl-para toluene sulfonamide, N,N-diethyl-chloro-acetamide and salicylanilide; and iv) the acyl halide compound is one or more of paraphthaloyl chloride, hexanoyl chloride, furoyl chloride, valeryl chloride, decanedioyl chloride, isobutyryl chloride, benzenemethanesulfonyl chloride, monomethyl oxalyl chloride, ethylsulfonyl chloride, p-fluorobenzoyl chloride, isophthaloyl chloride, o-phthaloyl chloride, methacryloyl chloride, diphenylcarbamyl chloride, m-methyl benzoyl chloride, 4-acetamidobenzenesulfonyl chloride, 2-bromoisobutyryl bromide, isophthaloyl bromide, 4-fluorobenzoylbromide, o-phenyldiformyl bromide, sebacoyl bromide and phenylmethylsulfonyl bromide; and wherein the auxiliary fire-extinguishing material is one or more of: a brominated flame retardant, a chlorinated flame retardant, an organophosphorus flame retardant, a phosphorus-halogen flame retardant, a nitrogen flame retardant, a phosphorus-nitrogen flame retardant, and an inorganic flame retardant.

2. The fire-extinguishing composition according to claim 1, wherein the additive is one or more of stearate, graphite, sodium silicate, phenolic resin, shellac, starch, dextrin, rubber, epoxy resin, acetal adhesive and hydroxypropyl methyl cellulose.

3. The fire-extinguishing composition according to claim 2, wherein the composition comprises:

55%-90% by mass of one or more of: the anhydride compound, the ester compound, the amide compound, and the acyl halide compound;

5%-40% by mass of the auxiliary fire-extinguishing material; and the additive 4%-8% by mass of the additive.

4. The fire-extinguishing composition according to claim 1, wherein the composition comprises 35%-90% by mass of an anhydride compound, wherein the anhydride compound is one or more of trimellitic anhydride, phthalic anhydride, succinic anhydride, 3,6 endomethenyl-1,2,3,6 tetrahydrophthalic anhydride, maleic anhydride, isatoic anhydride, 5-bromoisatoic anhydride, 1,8-naphthalic anhydride, creatinine, butanedioic anhydride (succinic anhydride), 1,8-naphthalic anhydride, benzoic anhydride and 2,3-dichloromaleic anhydride.

5. The fire-extinguishing composition according to claim 1, wherein the composition comprises 35%-90% by mass of an ester compound, wherein the ester compound is one or more of dimethyl oxalate, dimethyl terephthalate, polyvinyl acetate, triphenyl phosphate, butyl p-hydroxybenzoate, dicyclohexyl phthalate, benzyl hydrazinocarboxylate, methyl hydrazinocarboxylate, propylgallate, methyl gallate, L-ascorbyl palmitate, 1,1'-binaphthyl-2,2'-diyl hydrogen phosphate, 3-amino-4-methyl-toluate, 2-chlorobenzyl-N-succinimidyl carbonate, 4-methyl chlorocarbonylbenzoate, propyl p-hydroxybenzoate, methyl p-hydroxybenzoate and ethyl p-hydroxybenzoate.

6. The fire-extinguishing composition according to claim 1, wherein the composition comprises 35%-90% by mass of an amide compound, wherein the amide compound is one or more of phthalimide, para toluene sulfonamide, acetamide, salicylamide, acetanilide, N-hydroxymethyl acrylamide, acrylamide, propanamide, pentanamide, nicotinamide, benzamide, cinnamamide, isobutyramide, 4-acetamidobenzenesulfonyl chloride, amino-sulfamide, cyanoacetamide, trifluoroacetamide, 2-phenylacetamide, 2-chloroacetamide, L-glutamine, methacrylamide, thiobenzamide, 4-pyridine carboxamide, N-phenyl carboxamide, N-methyl carboxamide, anthranilamide, diacetone acrylamide, 4-aminobenzamide, 4-carboxybenzene sulfonamide, N-methylbenzamide, N-acetylcaprolactam, 2,6-dichlorobenzamide, N-methyl-para toluene sulfonamide, N,N-diethyl-chloro-acetamide and salicylanilide.

7. The fire-extinguishing composition according to claim 1, wherein the composition comprises 35%-90% by mass of an acyl halide compound, wherein the acyl halide compound is one or more of paraphthaloyl chloride, hexanoyl chloride, furoyl chloride, valeryl chloride, decanedioyl chloride, isobutyryl chloride, benzenemethanesulfonyl chloride, monomethyl oxalyl chloride, ethylsulfonyl chloride, p-fluorobenzoyl chloride, isophthaloyl chloride, o-phthaloyl chloride, methacryloyl chloride, diphenylcarbamyl chloride, m-methyl benzoyl chloride, 4-acetamidobenzenesulfonyl chloride, 2-bromoisobutyryl bromide, isophthaloyl bromide, 4-fluorobenzoylbromide, o-phenyldiformyl bromide, sebacoyl bromide and phenylmethylsulfonyl bromide.

* * * * *